US005261355A

United States Patent [19]

Scalfi

[11]. Patent Number: 5,261,355

[45] Date of Patent: Nov. 16, 1993

[54] BOILER HEAT EXCHANGER UNIT

[75] Inventor: Guido Scalfi, Lesmo, Italy

[73] Assignee: Pensotti S.p.A., Italy

[21] Appl. No.: 943,005

[22] Filed: Sep. 9, 1992

[30] Foreign Application Priority Data

Sep. 19, 1991 [IT] Italy ..... MI 91 U 000810

[51] Int. Cl.[5] ..... F22B 23/06; F22B 37/10

[52] U.S. Cl. ..... 122/367.3; 122/225 A; 165/181; 165/165

[58] Field of Search ..... 122/367.1, 367.2, 367.3, 122/223, 224, 225 R, 225 A, 225 B, 225 F, 226, 227, 228; 165/130, 181, 146, 185, 165

[56] References Cited

U.S. PATENT DOCUMENTS 4,886,018 12/1989 Ferroli ..... 122/367.3

*Primary Examiner*—Martin P. Schwadron

*Attorney, Agent, or Firm*—Shlesinger, Fitzsimmons & Shlesinger

[57] ABSTRACT

A heat exchanger unit (10) between flue gas and water in a boiler comprises internally first paths for the water and second paths for the flue gas. Walls (23) separating the first and second paths comprise fins (22) projecting therefrom in the second paths to be licked by the flue gas and perform heat transfer between the flue gas and the walls of the water paths.

Each fin (22) has substantially flat lateral faces (24,25) mutually inclined to taper downward and an upper end (27) and lower end (26) rounded to radius together said lateral faces (24,25).

6 Claims, 2 Drawing Sheets

BOILER HEAT EXCHANGER UNIT

Figure 1:
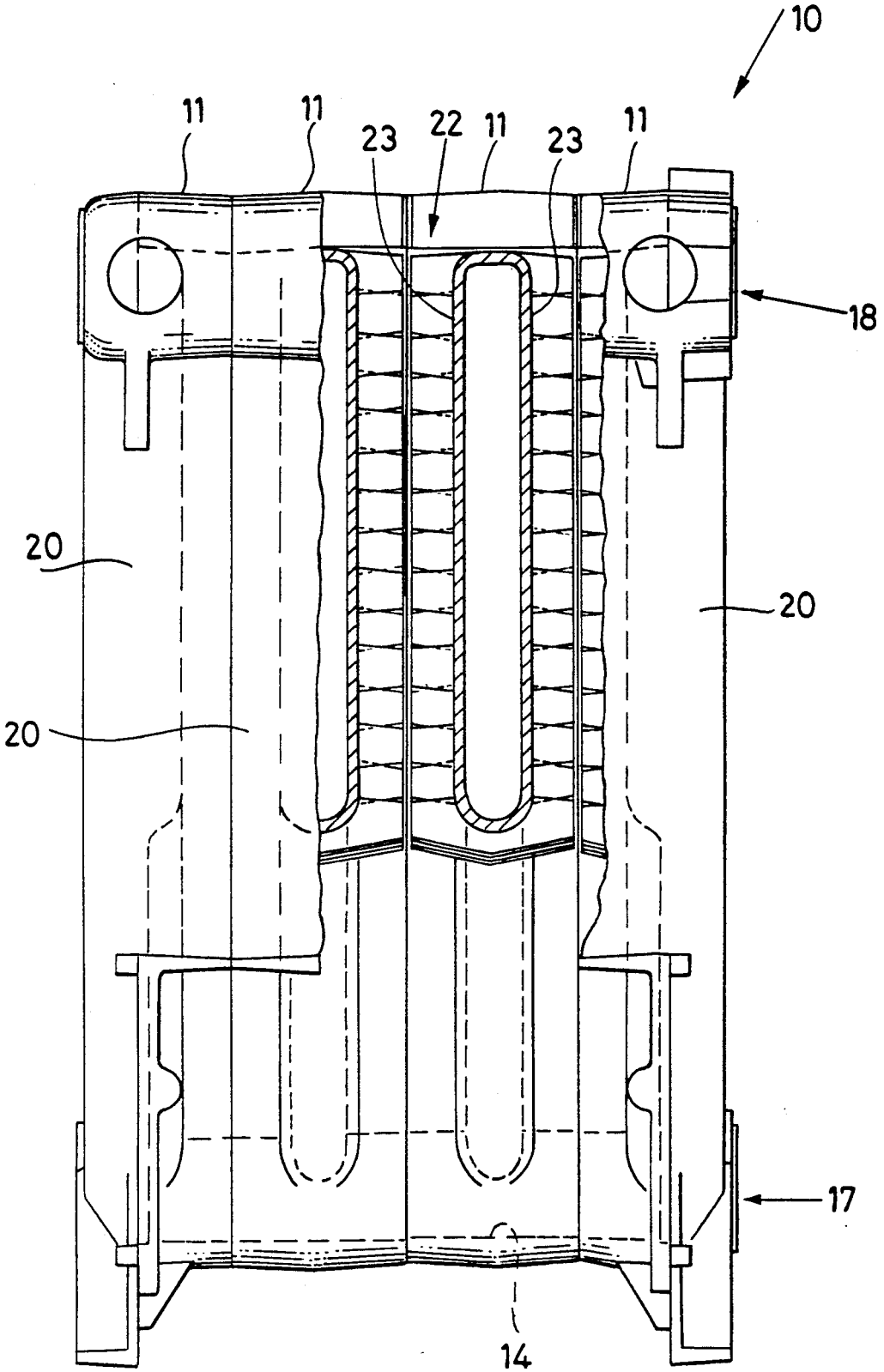

Boilers of the type comprising a burner in which the flue gas is made to pass through a heat exchanger to yield heat to water circulating therein are known.

Generally the passages for the flue gas in the exchanger comprise pluralities of fins arranged in the path of the flue gas to increase the exchange surface.

There have been proposed various forms for the fins. For example, fins of generally rectangular form flattened transversely to the flow of flue gas have been proposed.

Such fins have however poor efficiency because of the excessive turbulences which they cause in the flue gas. There have been proposed fins which reduce the turbulence thanks to their drop form with the tapered part toward the source of the flue gas so as to give them a form with low aerodynamic resistance. Unfortunately, this solution also suffers from a still limited efficiency due to the minimal part of flue gas which actually licks the fin surface, the greater part of the flue gas passing between the fins without touching them except occasionally.

The general object of the present invention is to obviate the above mentioned shortcomings by supplying a boiler heat exchanger having optimal efficiency in operation thanks to an innovative form of the fins placed along the flue gas path.

In view of said object it has been sought to provide in accordance with the present invention a heat exchanger between flue gas and water in a boiler of the type comprising internally first paths for the water and second paths for the flue gas, separating walls between the first and second paths comprising fins projecting therefrom into the second paths to be licked by the flue gas and perform thermal transfer between the flue gas and the walls of the water path and characterized in that each fin has substantially flat lateral faces inclined mutually to taper downward and upper and lower ends rounded to radius together said lateral faces.

Figure 2:
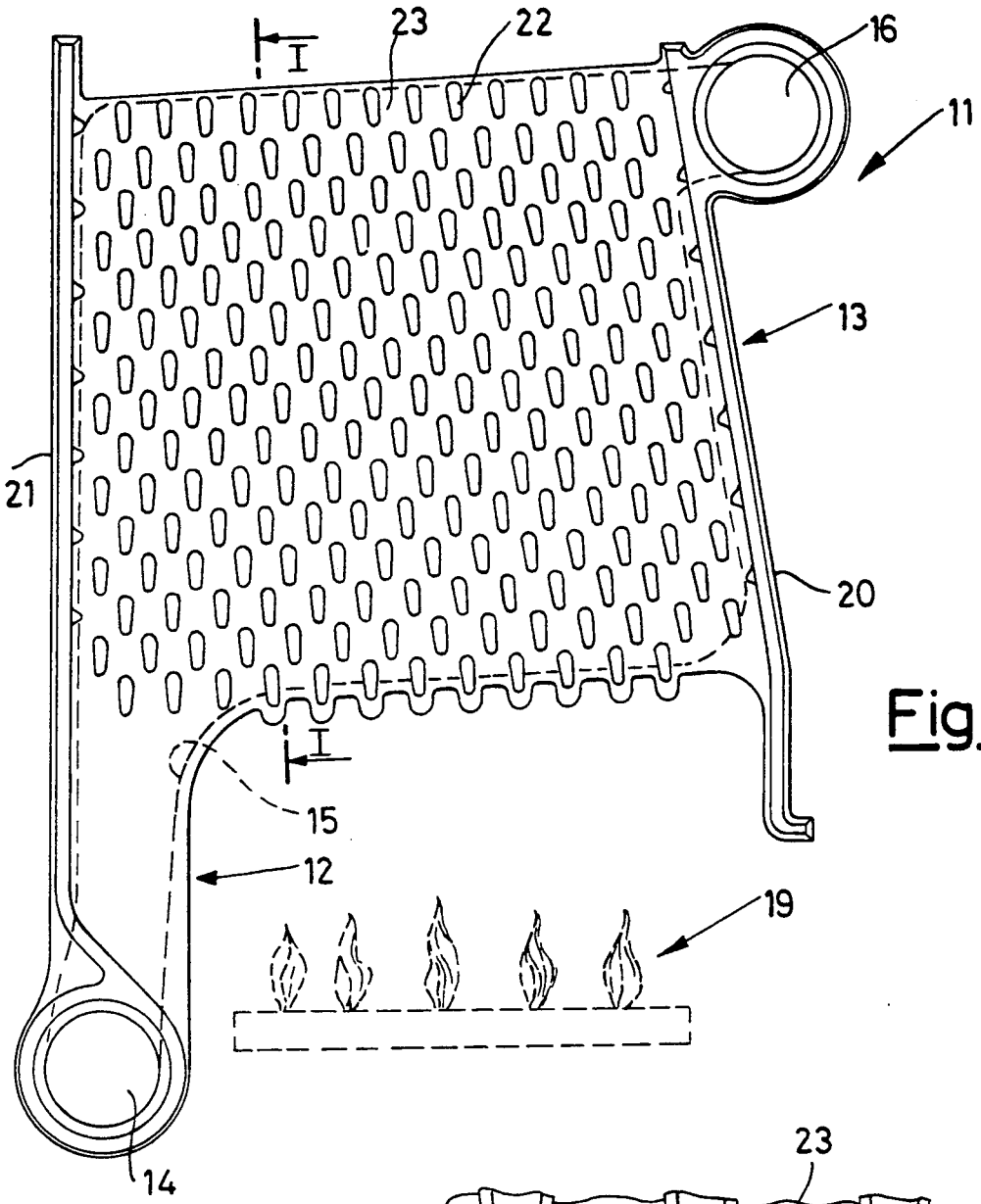
Figure 3:
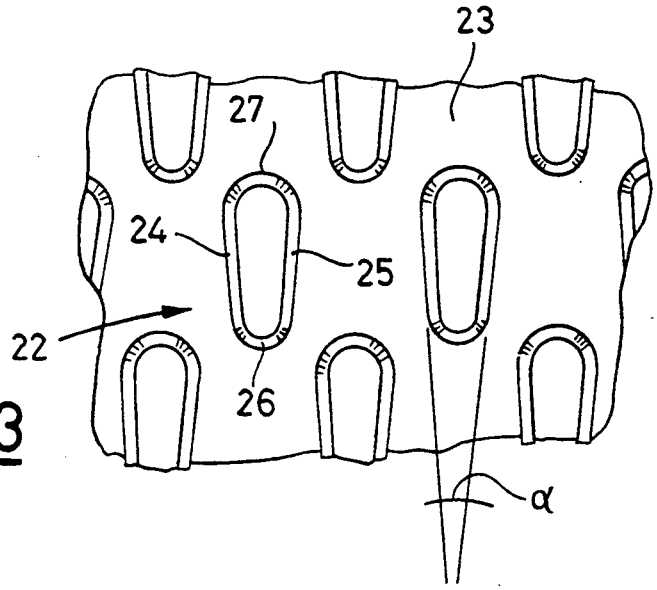

To further clarify the explanation of the innovative principles of the present invention and its advantages as compared with the known art there is described below with the aid of the annexed drawings a possible embodiment as a nonlimiting example applying said principles. In the drawings:

FIG. 1 shows a front elevation view partially sectioned along plane of cut I—I of FIG. 2 of a heat exchanger provided in accordance with the present invention, FIG. 2 shows a lateral elevation view of an element of the exchanger of FIG. 1, and FIG. 3 shows an enlarged view of a detail of the exchanger of FIG. 1.

With reference to the figures in FIG. 1 is shown a heat exchanger 10 consisting of a plurality of elements 11 side by side.

As is well seen in FIG. 2 each element 11 comprises a foot 12 and an upper exchange part 13. At the bottom of the foot is present laterally a passing inlet 14 connected to a chamber 15 inside the element and emerging in a lateral passing outlet 16 at the top of the exchanger 13. Inlets 14 and outlets 16 of the various side by side elements are juxtaposed so as to form inlet ducts 17 and outlet ducts 18 respectively for the water in the exchanger as is well seen in FIG. 1.

Below the exchange part 13 is arranged a burner 19 (indicated schematically in broken lines in FIG. 2) of the known art and therefore not further described nor shown. Lateral end walls 20 and 21 of the exchange elements 11 form a vertical path through which passes the flue gas produced by the burner 19 so as to lick the facing walls of the exchange parts 13 in which runs the water. To increase thermal exchange the facing walls 23 of the exchange part comprise a plurality of fins 22 projecting therefrom and arranged in the path of the flue gas in horizontal rows alternately offset as may be well seen in FIG. 2.

As shown in greater detail in FIG. 3 each fin has a cross section with flat lateral faces 24 and 25 inclined mutually with angle $\alpha$ and radiused by rounding lower 26 and upper 27 ends.

It has been found that the angle $\alpha$ can advantageously be between 4° and 16° and in particular approximately 10°. It has been found experimentally that surprisingly the particular form of the fins described permits considerably increasing the efficiency of the heat exchangers. Indeed, the flue gas which runs rapidly through the ducts formed by the air spaces between the exchange elements are forced by the form of the fins to raze with pressure nearly the entirety of the surface of the fins giving them greater heat absorption capacity. The form of the fins causes the flue gas, after having licked the fin, to deviate therefrom to lick with good adherence the substantially flat surface of the fin immediately above and staggered. In addition, apart from the slight deviation which allows licking of the fins with pressure, turbulences which would diminish the heat transfer between flue gas and fins are not generated.

As may be seen in FIG. 2 the pitch between the fins of a given horizontal row decreases toward the top of the exchanger and, in addition, the breadth of the flue gas duct (i.e. the distance between the walls 20 and 21) also decreases toward the top. In this manner the proportional and gradual reduction of the width of the flue gas ducts and the distance between the fins causes substantial uniformity of flue gas velocity compensating for its reduced volume caused by cooling during its travel upward. This also establishes a transmission coefficient constant. Naturally the above description of an embodiment applying the innovative principles of the present invention is given merely by way of example and therefore is not to be taken as a limitation of the patent right claimed here. For example, the form of the exchange elements can be different from that shown just as the form of the water passage ducts can be different to adapt to particular conformations and structures of the boiler as is easy to imagine for those skilled in the art.

I claim:

1. Heat exchanger unit (10) for transferring heat between flue gas and water in a boiler of the type having internally thereof first paths for the water and second paths for conveying the flue gas upwardly in the boiler, a plurality of spaced walls (23) positioned between and separating the first and second paths, and a plurality of spaced fins (22) projecting from one side of each of said walls into an adjacent one of said second paths to be licked by the flue gas and perform heat transfer between the flue gas and the water in said first paths, and characterized in that each said fin (22) has substantially flat lateral faces (24,25) which lie in mutually inclined planes, and which taper downwardly in the boiler, and has upper (27) and lower (26) end surfaces radiused together with said lateral faces (24,25).

2. Exchanger unit in accordance with claim 1 characterized in that said faces (24,25) and said planes in which they lie are mutually inclined with respect to each other at an angle $\alpha$ between 4° and 16° and preferably approximately 10°.

3. Exchanger unit in accordance with claim 2 characterized in that the fins (22) are arranged in horizontal rows mutually and alternately staggered.

4. Exchanger unit in accordance with claim 3 characterized in that the pitch between the fins (22) in each horizontal row decreases upward in the exchanger.

5. Exchanger unit in accordance with claim 2 characterized in that the cross section of the paths of the flue gas decreases upward in the exchanger.

6. Exchanger unit in accordance with claim 1 characterized in that said unit comprises a plurality of exchange elements (11) each of generally flat form and comprising a pair of said spaced walls (23) which form therebetween an internal cavity providing a path for the water and which form externally of each said element (11) a plurality of said fins, and the exchange elements (11) being secured side by side to provide at least partially between said fins and said walls (23) the flue gas paths.

* * * * *